United States Patent [19]

Soubry et al.

[11] Patent Number: 4,523,664

[45] Date of Patent: Jun. 18, 1985

[54] SAFETY DESCENT DEVICE

[76] Inventors: Garry V. Soubry, 6150 W. Cheyenne, Las Vegas, Nev. 89108; James L. MacFarlane, 5848 Sinaloa Ct., Las Vegas, Nev. 89103

[21] Appl. No.: 596,019

[22] Filed: Apr. 2, 1984

Related U.S. Application Data

[63] Continuation-in-part of Ser. No. 500,977, Jun. 8, 1983, Pat. No. 4,480,716.

[51] Int. Cl.[3] ..... A62B 1/12; A62B 1/16

[52] U.S. Cl. ..... 182/233; 182/238; 188/268; 254/377

[58] Field of Search ..... 182/233, 238; 188/268, 188/290; 242/99; 254/357, 377

[56] References Cited

U.S. PATENT DOCUMENTS

| | | | |
|---|---|---|---|
| 439,191 | 10/1890 | Roper | 182/238 |
| 3,847,377 | 11/1974 | Byrd | 242/99 |
| 3,879,016 | 4/1975 | Kankkunen | 182/238 |
| 4,088,201 | 5/1978 | McFarlane | 182/5 |
| 4,098,375 | 7/1978 | Kornylac | 188/268 |
| 4,154,328 | 5/1979 | Higgins | 188/268 |
| 4,416,351 | 11/1983 | Geurtsen | 254/377 |
| 4,452,430 | 6/1984 | Kankkunen | 254/377 |
| 4,463,830 | 8/1984 | Geurtsen | 254/377 |
| 4,480,716 | 11/1984 | Soubry | 182/233 |

*Primary Examiner*—Reinaldo P. Machado
*Attorney, Agent, or Firm*—Seiler, Quirk & Tratos

[57] ABSTRACT

A portable descent device for lowering an object at a controlled speed has a rotating spool carrying wrapped cable mounted within a casing. The spool rotates about a fixed shaft in a sealed chamber containing a viscous liquid. A series of alternating, closely adjacent, flat, parallel, rotatable and non-rotatable discs are mounted in the sealed chamber and extend radially of the shaft. As cable is payed out from the device, movement of the rotatable discs through the fluid creates a frictional drag which slows the descent rate to a relatively constant, safe speed.

14 Claims, 5 Drawing Figures

SAFETY DESCENT DEVICE

RELATIONSHIP TO OTHER APPLICATIONS

This application is a continuation-in-part of application Ser. No. 500,977 entitled high-rise Escape Device, filed June 3, 1983 and now U.S. Pat. No. 4,480,716.

BACKGROUND OF THE INVENTION

This invention relates to devices for safely lowering loads from substantial heights. In a preferred embodiment, it relates to compact portable devices which may be used to lower a person from an elevated location, such as a high-rise building, to the ground in an emergency.

The lowering of heavy objects from highly elevated levels to the ground is not an uncommon task. Of particular concern in recent years is the safety of persons on upper floors of high-rise buidings, such as apartments, office buildings, and hotels. In the event of a fire or other emergency, it is necessary for persons located on the upper stories of such buildings to make a rapid exit. In the event of a fire, normal escape routes within the building may be foreclosed, and conventional fire truck ladders have a limited vertical capability.

In the past, a number of different types of portable reel and line devices have been proposed which can be used by a person to lower himself to the ground by paying out the line or cable from the reel at a controlled rate. In general, these devices may be separated into two different groups; the first group retards the rate of descent by frictional braking means, and the second slows the descent by rotating a rigid member through a viscous liquid. Of this latter group, examples are found in Byrd, U.S. Pat. No. 3,847,377, Roper, U.S. Pat. No. 439,191, and Macfarlane, U.S. Pat. No. 4,088,201. Mechanical devices have proven generally unreliable; it has been quite difficult to properly adjust the particular degree of friction required to provide the desired rate of descent, and the quantity of heat generated in the mechanical devices has often been so great as to have a very substantial effect on the rate of descent, or even cause failure of the devices.

A substantially improved escape device is enclosed in the previously mentioned patent U.S. Pat. No. 4,088,201 to MacFarlane, one of the inventors herein. In that patent, a cable is wound about a spool which is enclosed within a casing. The casing includes an axially extended portion which houses a chamber containing a rotatable member in a viscous fluid. Rotation of the member in the fluid results in a frictional drag which controls the rate of descent of a person attached to the cable.

The present invention provides an improved design of a load descent device in which the rate of descent is controlled by rotation of a member in a viscous fluid. The present invention contemplates a highly efficient, inexpensively manufactured, and compact unit which has a virtually indefinite shelf life and is substantially fail-safe. The basic concept of the invention contemplates a housed spool having a hollow interior which forms a sealed, fluid-filled chamber. A series of parallel discs or plates are mounted within the chamber and are alternatingly rotatable or fixed. As cable is pulled from the housing, the spool rotates within the housing, turning the rotatable plates in the chamber. The close proximity of the movable and fixed plates within the chamber create substantial drag which is proportional to the speed of rotation of the spool. Accordingly, the viscosity of the fluid and spacing of the plates are chosen such that an average person will descend at a relatively uniform rate of about 4 feet per second.

Accordingly, it is an object of the present invention to provide a load descent device which is highly compact, and easily manufactured, yet is virtually foolproof. It is yet another object of the invention to provide an escape device which descends with the user so that it may be reused. It is yet another object of the invention to provide an escape device in which the cable cannot retreat into the interior of the housing, thereby causing jamming of the cable. These and other objects are effected by the device of the invention, a detailed description of an embodiment thereof being disclosed herein.

BRIEF SUMMARY OF THE INVENTION

A portable descent device which comprises a casing, a spool having a hollow interior rotatably mounted in the casing, and a cable wound around the spool and having a portion thereof extending exteriorly of the casing through an aperture therein. A shaft is fixedly mounted in the casing and extends axially through the spool which is mounted so as to rotate about the shaft. The spool is hollow and its walls form a sealed interior chamber which contains a viscous liquid, such as a silicone fluid. A plurality of spaced parallel discs having flat, radially extending surfaces are mounted within the sealed chamber; the discs are alternatingly fixed and rotating.

BRIEF DESCRIPTION OF THE DRAWINGS

The invention is best understood with reference to the drawings, in which.

DETAILED DESCRIPTION OF A PREFERRED EMBODIMENT

Figure 1:
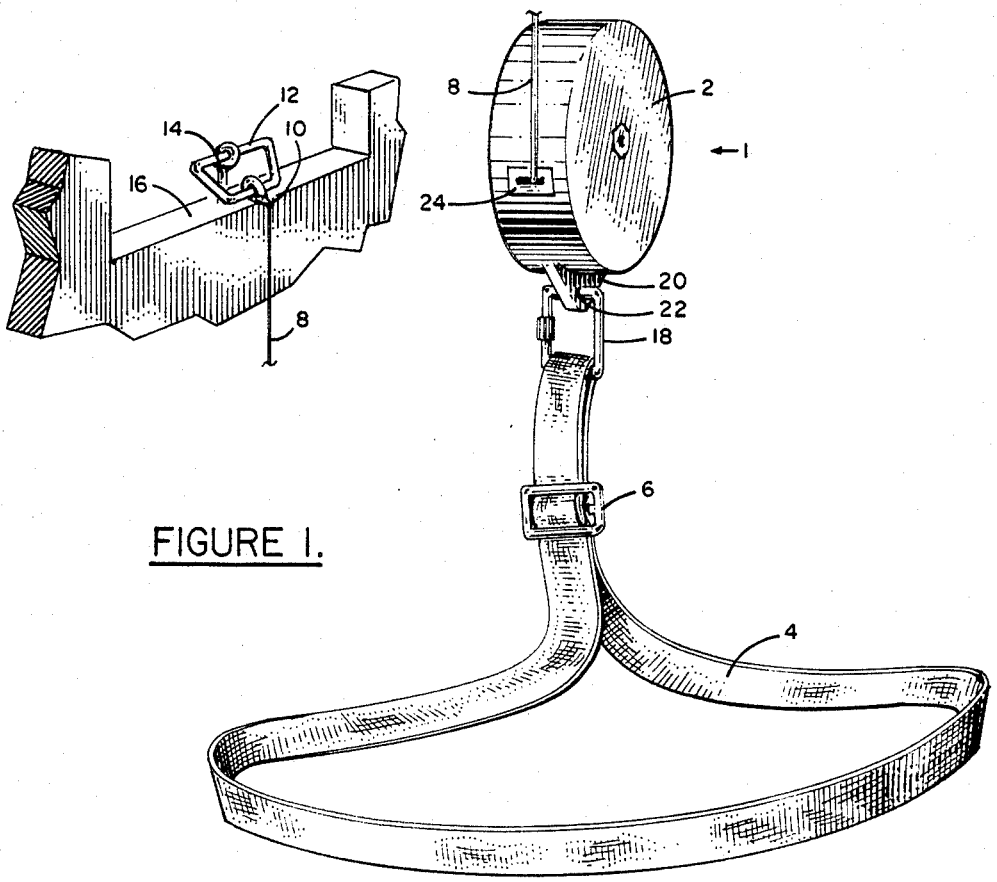
FIG. 1 is a perspective view of the device of the invention having an attached body support harness.

Referring first to FIG. 1, descent device 1 comprises a casing or housing 2 attached to a belt 4 which is adapted to secure the object or person to be lowered by the device. A buckle 6 is used to adjust the length of the belt to the size of the object to be lowered. The belt is fastened to the device by means of a metal connecting loop 18 which passes through an eye 22 in a lug or flange 20 at a lower portion of the device. A cable 8 is payed out from the casing as the object is lowered toward the ground. The upper end 10 of the cable may be removably fastened to any fixed object in a room or attached to the building; as shown in FIG. 1, the cable is attached to a connecting member 12 which is fastened to a stake 14 embedded in the window ledge 16. The particular method of attachment of the device to a building is not a part of the invention and may vary; in many cases, it may be desirable to mount the devices at a distance from the window to preclude smoke inhalation during the descent.

Figure 2:
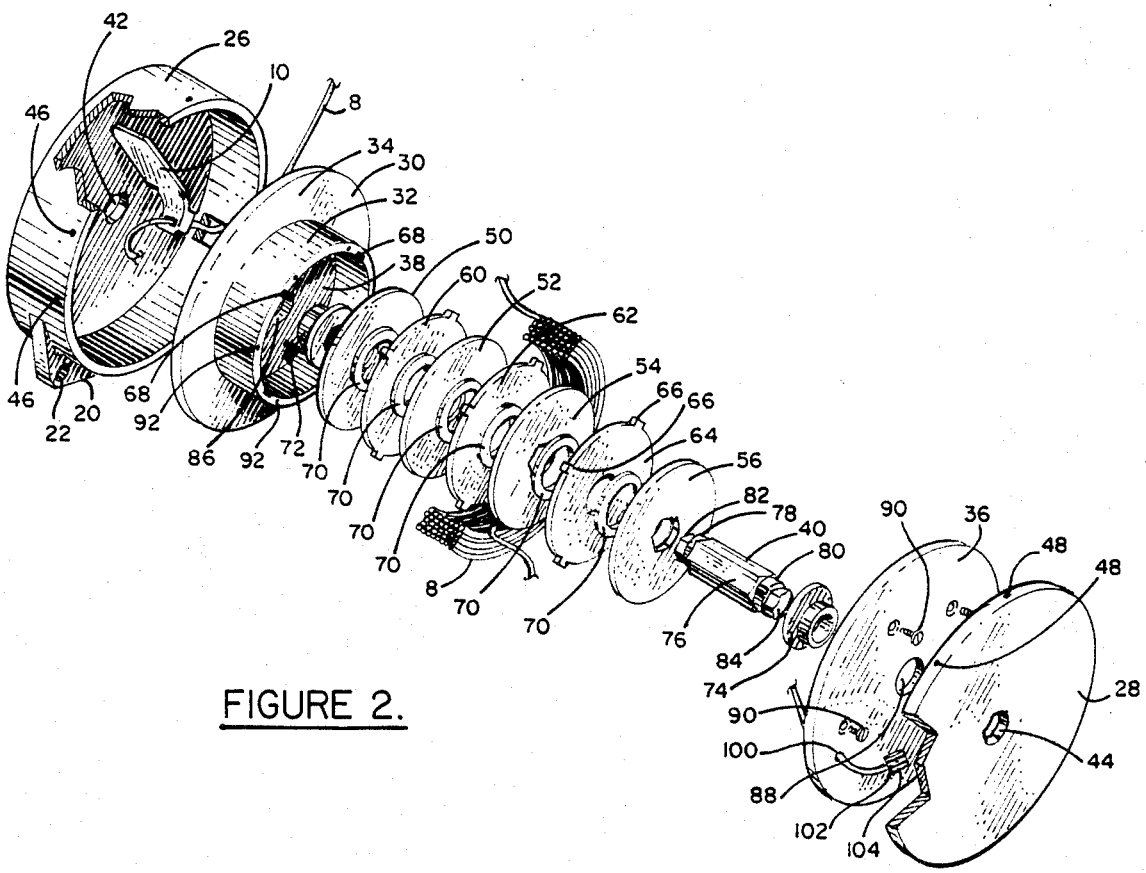
FIG. 2 is an exploded perspective view of the device showing the various components which comprise the invention.
Figure 3:
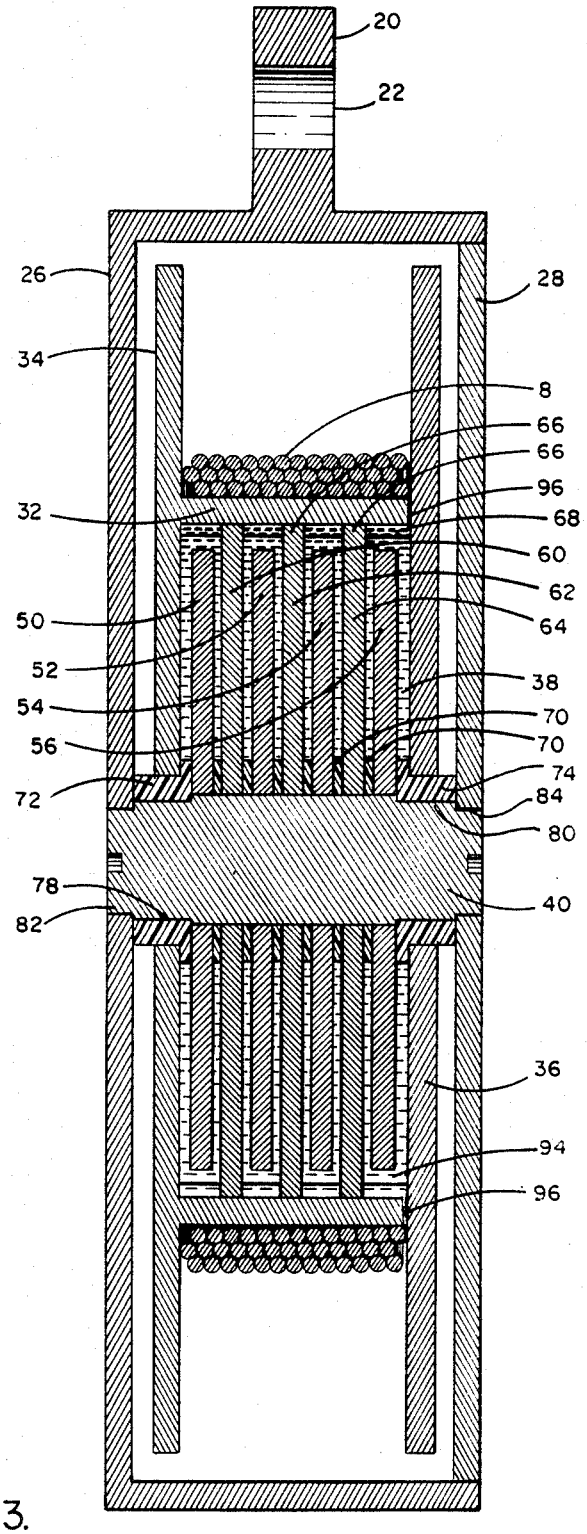
FIG. 3 is a side elevational section view of the device.

The internal configuration of the descent device 1 is best seen in FIGS. 2 and 3. The casing 2 is comprised of first and second housing portions 26 and 28, portion 28 consisting of a cap which is fastened in place by screws which extend radially through threaded bores 46 around the periphery of housing portion 26 and threaded bores 48 which align therewith. A spool 30 is rotatably mounted inside of the casing and is comprised of hollow cylindrical body portion 32 which is cast integrally with side flange 34, and spool side member 36 which is fastened to the spool body by screws. As shown in FIG. 2, radially disposed screws 90 extend through bores in spool side 36 and engage threads in bores 92 in the side of the spool body. The cable 8 is wound around the spool body and extends outwardly through a transverse slot 24 in guide 110.

The interior of the spool is hollow and a sealed chamber 38 is formed when the spool side 36 is fastened tightly in place. A series of alternating rotors and stators are mounted around a fixed shaft 40 which extends axially through the casing and has its opposite ends secured non-rotatably to the opposing casing walls. Hexagonal end portions 82 and 84 of the shaft 40 fit slidably into hexagonal bores 42 and 44 in casing walls 26 and 28, respectively, such that the shaft is rotationally locked to the casing.

Spaced inwardly from the opposite hexagonal ends of the shaft are cylindrical portions 78 and 80, and a long central hexagonal portion 76 of slightly greater diameter than the hexagonal end portions. Mounted on the central shaft portion 76 are four identical spaced parallel discs 50, 52, 54, and 56. These discs have centrally located hexagonal bores of a size very slightly larger than the diameter of the shaft, thereby precluding relative rotational movement of the fixed discs and the shaft when the discs are in place thereon. Spaced between the fixed discs are three similar circular discs 60, 62, and 64 which are affixed to and rotate with the spool. The rotating discs are attached to the spool by means of radially projecting ears 66 which are equally spaced at quadrants around the periphery of each rotating disk. The ears register with slots or grooves 68 located around the internal periphery of spool body 32. The rotating discs have centrally located bores which are circular and which are of greater diameter than the largest portion of the hexagonally shaped center section of the shaft 40, thereby permitting free rotation of these discs around the shaft. Both the fixed and the rotating discs are thin, flat, circular members, having flat parallel sides.

The rotors and stators are mounted on the shaft and are spaced by a plurality of washers or spacing rings 70. The spacers serve to maintain the proper distance between the rotors and stators, and also serve as a seal to permit fluid from traveling along the shaft. Identical nylon bearing members 72 and 74, which have multiple functions, are mounted on the cylindrical portions 78 and 80 of the shaft by a press fit. These bearings extend through circular openings in the side walls of the spool, and provide a relatively low friction surface of rotation around which the spool may turn. In addition to rotationally mounting the spool, these sleeves also provide a seal which precludes leakage of fluid around the shaft, and the internal flange portion of the sleeve also serves as a spacer to separate the outermost fixed discs from the spool wall.

Sealed chamber 38 is formed in the annular interior portion of the spool. The chamber is fluid tight, and leakage is precluded by the inclusion of a gasket material 96 around the circular periphery of the spool body at the location where the body abuts the spool wall 36. The annular passage is filled with a viscous fluid such as dimethylpolysiloxane. A suitable commercially available fluid is Dow Corning 200 fluid, which is clear silicone liquid having a viscosity from about 200,000–2,000,000 cs at 25 C., but is preferably near the lower end of the viscosity range, eg, 200,000–300,000 cs. In addition to being an effective retardant for rapid rotation of the discs, this fluid is a heat conductor which will dissipate heat through the metallic casing. The viscous fluid exerts a retardant action on the hollow interior surfaces of the spool which forms the outer walls of the annular chamber 38, and the close spacing of the rotors and stators within the chamber provide a relatively large surface area to provide additional frictional retarding force.

The fluid properties are extremely important for the device of the invention. It has been found that when the device is initially placed in use, the fluid heats up very rapidly, and the fluid viscosity may decrease unexpectedly quickly prior to establishment of heat transfer through the casing. Initial fluid temperatures have been found to quickly rise to 120° C. or more. Accordingly, it is important that the fluid have a relatively flat viscosity/temperature curve. It is preferred that the decrease in viscosity with increasing temperatures be less than about 4500 cs./degree Centigrade from about 0° C.–120° C. In addition, it is important that the fluid not have substantial thixotropicity, i.e., that the viscosity decrease with shear not be substantial. It is preferred that the viscosity decrease be less than 20% when measured with a Brookfield visco-meter, using a number 6 or number 7 spindle between 1 rpm and 100 rpm.

The use of alternating rotating and fixed flat parallel discs permits a large surface area of exposure to the fluid within a very small chamber volume. A typical dimension for the discs would be approximately 40 mm diameter and about 3 mm thickness, with a spacing between the discs of approximately 0.75 mm. Depending on the particular design of the device and the weight of the object for which descent is desired, a larger or smaller number of fixed and rotating discs maybe used. A total minimum number of discs is three, and the maximum number is dictated by cost, weight of the object to be lowered, and practicality. In general, a total of from 4–8 discs and preferably 5–7 discs is desired. The fluid 94 in the sealed chamber may of course be any desired viscous fluid which has the properties of being able to frictionally retard the rotation of the spool to provide a desired descent rate. The spacing between the fixed and the adjacent rotating discs is very important, ranging from 0.015" to about 0.10", and preferably from about 0.025" to about 0.04", in models designed for loads of about 60–300 lbs. In general, this spacing is determined as a function of the weight to be lowered, desired descent velocity, fluid viscosity, and area of contact between the discs and the fluid.

Figure 4:
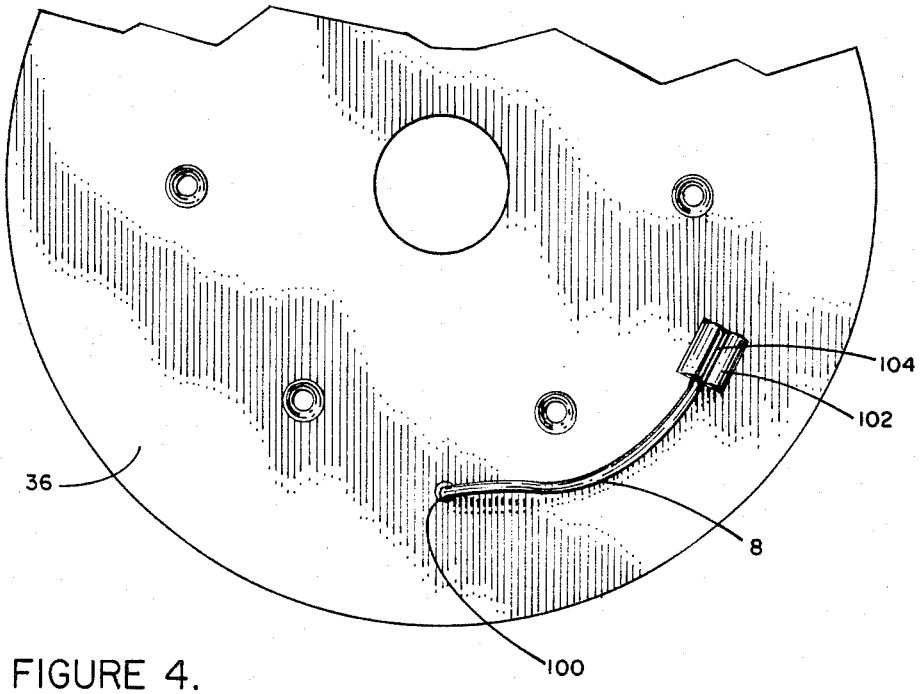
FIG. 4 is a partial view showing the attachment of one end of the cable to the spool.
Figure 5:
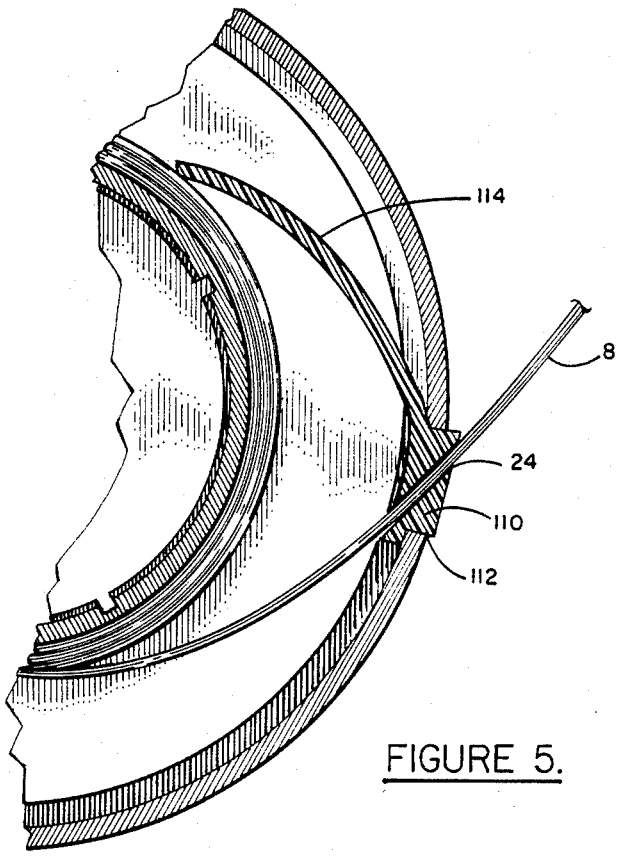
FIG. 5 is a partial side section view showing an anti-jamming cable guide of the invention.

One end of the cable 8 is fixed to the spool itself by extending through a bore 100 in the spool wall located radially outside of the sealed chamber. The end of the cable 8 is crimped into a conventional crimping fastener 104, as best seen in FIG. 4, which is then pressed into a rectangular opening 102 in the spool wall. This simply prevents the end of the cable from interfering with the rotation of the spool. The other end of the cable 8 extends outwardly through a slot 24 in a cable guide 110 which is mounted in a rectangular window in the cylindrical casing wall. A tongue portion of the cable guide having about the same width as the windings extends inwardly tangentially to the wrapped cable and assists in preventing backlash of the cable as it is payed out from the interior of the casing. The tongue portion exerts pressure on the windings, helping to prevent uncoiling of the cable from its tightly wrapped condition when not in use.

Variation in the construction and materials of the device of the invention will of course be apparent to those skilled in the art. The casing, spool, shaft, and discs are preferably metal, with aluminum being particularly preferred because it is strong, light-weight, and a good heat conductor. The specific amount of drag exerted by rotation of the spool is affected by the size and spacing of the disk, the number of discs, the speed of rotation, and certain fluid properties such as viscosity, thixotropicity, and the like. It is also important that all of the dissolved air be removed from the fluid prior to insertion into the sealed chamber. In general, the speed of descent is approximately linearly proportional to the weight of the object descending; a desirable target for design of the device is to have a 250 pound object descend at the rate of approximately four feet per second.

The operation of the device of the invention is described with reference to a preferred usage thereof, namely, for enabling a rapid escape from a high-rise building in an emergency. In this use, devices of the invention may be provided in each room of a high-rise building. Alternatively, a person can carry a portable device around with him throughout his travels.

In the event of a fire or an emergency wherein escape from a high-rise building is necessary, the free end 10 of the cable with its means for attachment to the building, which may be a spring-operated clip fastener, is quickly secured to a permanent part of the high-rise structure adjacent to a window or otherwise attached to the building. The entrapped person then quickly secures the supporting belt 4 about his waist and then carefully lowers himself, with the cable 8 being automatically payed out from the casing 2.

Upon reaching the ground, the cable may simply be cut from the casing itself, or the casing may be opened and the cable detached from the spool. If the building is accessible, the top of the cable may be removed and the cable rewound on the spool. In any case, the casing and its internal components may be reused after inserting a new cable, thereby saving the expense of construction of an entirely new device.

A variety of modifications may be made in the device within the spirit and scope of the invention, the essence of which is the retarding of the speed of cable unwinding by a plurality of rotors and stators configured according to the invention and immersed in a viscous fluid. Accordingly, the invention should not be limited by the preceding description of a preferred embodiment thereof, but should rather be limited by the following claims.

I claim:

1. A portable descent device comprising a casing, a spool having a hollow interior rotatably mounted in the casing, a cable wound around the spool and having a portion thereof extending exteriorly of the casing through an aperture therein, a shaft extending axially through said spool, a sealed chamber interior of the spool containing a viscous liquid, at least one non-rotatable disk extending radially from the shaft within said chamber, and a plurality of rotatable flat discs mounted parallel to and spaced from the non-rotatable discs.

2. The device of claim 1 having a total of at least four alternating rotatable and non-rotatable discs.

3. The device of claim 1 having a total of from 5 to 7 rotatable and non-rotatable discs.

4. The device of claim 1 wherein the rotatable discs are spaced from the non-rotatable discs by 0.015" to about 0.1".

5. The device of claim 1 wherein the rotatable discs are spaced from the non-rotatable discs by about 0.025" to about 0.04".

6. The device of claim 3 wherein the rotatable discs are spaced from the non-rotatable discs by 0.015" to about 0.1".

7. The device of claim 3 wherein the rotatable discs are spaced from the non-rotatable discs by about 0.025" to about 0.04".

8. The device of claim 1 wherein the shaft is non-rotatably mounted in the casing.

9. The device of claim 1 wherein the spool is rotatably mounted around the shaft.

10. The device of claim 1 wherein the rotatable discs are fixedly mounted to the spool in the interior chamber hereof.

11. The device of claim 1 wherein the liquid has a viscosity of at least 200,000 cs at 25° C.

12. The device of claim 1 wherein the liquid has a viscosity of about 200,000–300,000 cs at 25° C., and has a decrease in viscosity of not greater than 4,500 cs/°C. between 0° C. and 120° C.

13. A portable descent device comprising a casing, a spool having a sealed interior chamber rotatably mounted in the casing, a cable wound around the spool and having a portion thereof extending exteriorly of the casing through an aperture therein, a shaft non-rotatably mounted axially in the casing and extending along the axis of rotation of the spool, a viscous liquid contained in the sealed chamber annularly of the shaft, and a plurality of alternating parallel rotatable and non-rotatable discs mounted in close proximity in the chamber such that rotation of the spool caused by paying out of the cable creates functional drag by movement of the rotatable discs through the viscous liquid.

14. The device of claim 13 wherein the non-rotatable discs are fixedly mounted to the shaft, and the rotatable discs are fixedly mounted to the spool.

* * * * *